US009927754B1

(12) United States Patent
Taki

(10) Patent No.: US 9,927,754 B1
(45) Date of Patent: Mar. 27, 2018

(54) IMAGE FORMING SYSTEM THAT ADJUSTS A DISCHARGE INTERVAL FROM AN IMAGE FORMING SECTION ACCORDING TO AN ACCUMULATED NUMBER OF ROTATIONS OF A DRIVEN MEMBER IN A POST PROCESSING SECTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/256,889

(22) Filed: Sep. 6, 2016

(51) Int. Cl.
*G03G 15/00* (2006.01)

(52) U.S. Cl.
CPC ..... *G03G 15/55* (2013.01); *G03G 15/6582* (2013.01); *B65H 2601/121* (2013.01)

(58) Field of Classification Search
CPC ..... G03G 15/55; B65H 5/34; B65H 2601/121
See application file for complete search history.

(56) References Cited

U.S. PATENT DOCUMENTS

| | | | | |
|---|---|---|---|---|
| 6,507,768 | B1 * | 1/2003 | Regimbal | B41J 13/0009 700/213 |
| 7,559,543 | B2 * | 7/2009 | Moriyama | B42C 1/125 270/58.02 |
| 8,146,907 | B2 * | 4/2012 | Kato | B65H 7/10 270/58.07 |
| 2007/0009270 | A1 * | 1/2007 | Kawano | G03G 15/6529 399/13 |

FOREIGN PATENT DOCUMENTS

| | | |
|---|---|---|
| JP | 10-181989 | 7/1998 |
| JP | 2002-006692 | 1/2002 |

* cited by examiner

*Primary Examiner* — Justin Olamit
(74) *Attorney, Agent, or Firm* — Amin, Turocy & Watson LLP; Gregory Turocy

(57) ABSTRACT

In accordance with an embodiment, a post-processing apparatus comprises a memory that stores a threshold value and a first accumulated data of a physical quantity of one of a motor or a driven member driven by the motor; and a controller that acquires a predetermined data associated with a physical quantity of one of the driving motor or the driven member driven by the motor, acquires a second accumulated data by adding the predetermined data to the first accumulated data read from the memory, compares the second accumulated data with the threshold value, and transmits a request for increasing a discharge interval of the sheet if the second accumulated data is greater than the threshold value.

20 Claims, 6 Drawing Sheets

IMAGE FORMING SYSTEM THAT ADJUSTS A DISCHARGE INTERVAL FROM AN IMAGE FORMING SECTION ACCORDING TO AN ACCUMULATED NUMBER OF ROTATIONS OF A DRIVEN MEMBER IN A POST PROCESSING SECTION

FIELD

Embodiments described herein relate generally to a post-processing apparatus, a control method and an image forming system.

BACKGROUND

There is an image forming system equipped with a post processing apparatus for carrying out a post-processing on a sheet and an image forming apparatus. The post-processing apparatus is equipped with various driven members. Parts of the driven members are driven by a DC (Direct Current) motor. A rotational speed of the DC motor is reduced if the DC motor approaches the end of its lifetime.

If the rotational speed of the DC motor is reduced, a drive speed of the driven member is also reduced. If the drive speed of the driven member is reduced, there is a case in which a paper jam occurs or an alignment state of discharged sheets becomes faulty. In this way, if the rotational speed of the DC motor is reduced, there is a case in which a stable operation of the post-processing apparatus is not maintained.

DETAILED DESCRIPTION

In accordance with an embodiment, a sheet processing apparatus comprises a sheet processing section configured to carry out a sheet processing on a sheet discharged from an image forming apparatus; a motor configured to drive a driven member of the sheet processing section; a memory configured to store a threshold value and a first accumulated data of a physical quantity of one of the motor or the driven member driven by the motor; and a controller configured to acquire a predetermined data associated with a physical quantity of one of the driving motor or the driven member driven by the motor, acquire a second accumulated data by adding the predetermined data to the first accumulated data read from the memory, compare the second accumulated data with the threshold value, and transmit a request for increasing a discharge interval of the sheet discharged from the image forming apparatus to the image forming apparatus if the second accumulated data is greater than the threshold value.

Figure 1:
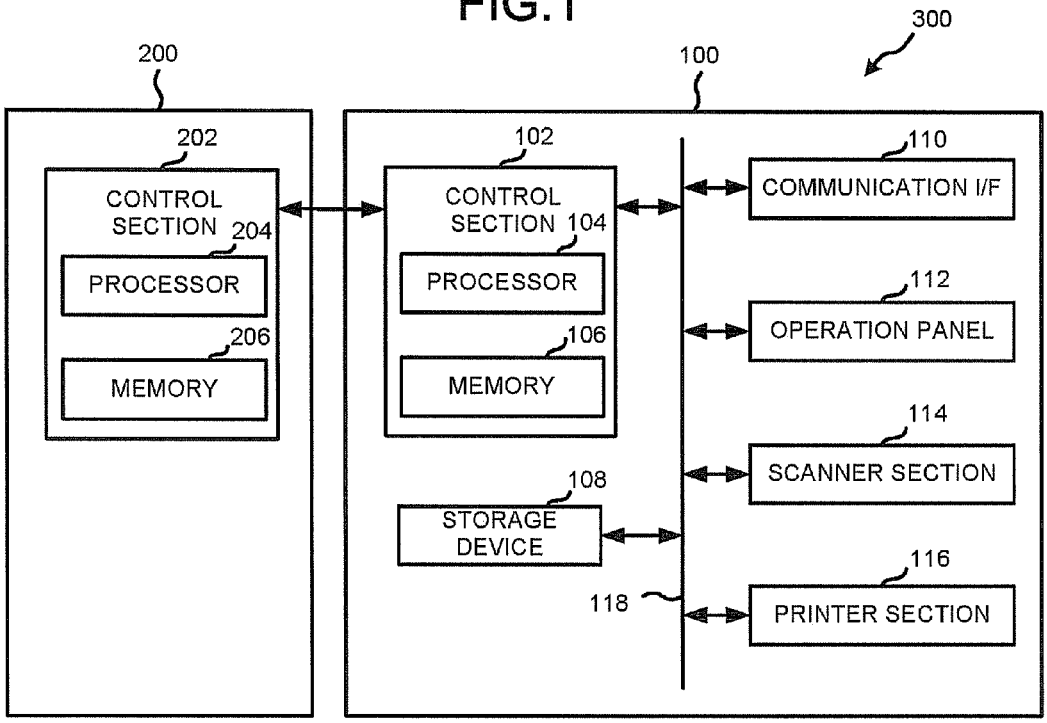
FIG. 1 is a diagram illustrating the schematic configuration of an image forming system according to an embodiment.

FIG. 1 is a diagram illustrating the schematic configuration of an image forming system 300. The image forming system 300 is composed of an image forming apparatus 100 and a post-processing apparatus 200. The image forming apparatus 100 has a control section 102 (controller), a storage device 108, a communication interface (communication I/F) 110, an operation panel 112, a scanner section 114 and a printer section (image forming section) 116 for forming an image. Components of the image forming apparatus 100 are connected with each other via a bus line 118.

The control section 102 has a processor 104 composed of a CPU (Central Processing Unit) or a MPU (Micro Processing Unit) and a memory 106. The memory 106 has a ROM (Read Only Memory) and a RAM (Random Access Memory).

A control program is stored in the ROM. The RAM provides a temporary working area for the processor 104.

The control section 102 controls each section on the basis of various programs stored in the ROM or the storage device 108. For example, the control section 102 controls the operation panel 112, the scanner section 114 and the printer section 116. The control section 102 includes a function of correcting image data or a function of expanding the image data. Further, the control section 102 communicates with a control section 202 of the post-processing apparatus 200.

The storage device 108 stores application programs and an OS (Operating System). The application programs include programs for realizing functions of a multi-function peripheral. As the functions of the multi-function peripheral, for example, a copy function, a print function, a scan function, a facsimile function and a network file function are listed. The application programs include an application for Web client (Web browser) and other applications.

The storage device 108 temporarily stores image data of a document read by the scanner section 114 or image data acquired via the communication I/F 110. The storage device 108 properly stores software update, a protected electronic document, text data, account information and policy information.

The storage device 108 is composed of at least one or more of a magnetic storage device, an optical storage device and a semiconductor storage device.

The communication I/F 110 is an interface connecting with an external device. The communication I/F 110 connects with the external device through a wireless or a wired manner. As a wireless or a wired standard, for example, Bluetooth® Technology, IEEE802.15, IEEE802.11, IEEE802.3 and IEEE1284 are listed. The communication I/F 110 may be a USB connection section to which a connection terminal of a USB standard is connected or a parallel interface.

The control section 102 communicates with a user terminal, a USB device or another external device via the communication I/F 110.

The post-processing apparatus 200 has the control section 202 and a plurality of members described later. The control section 202 (controller) has a processor 204 composed of a CPU or a MPU and a memory 206.

The memory 206 has a ROM and a RAM. A control program is stored in the ROM. The RAM provides a temporary working area for the processor 204.

The control section 202 communicates with the control section 102 of the image forming apparatus 100. The control section 202 controls a plurality of the members described later on the basis of information received from the control section 102 or various programs stored in the ROM.

Figure 2:
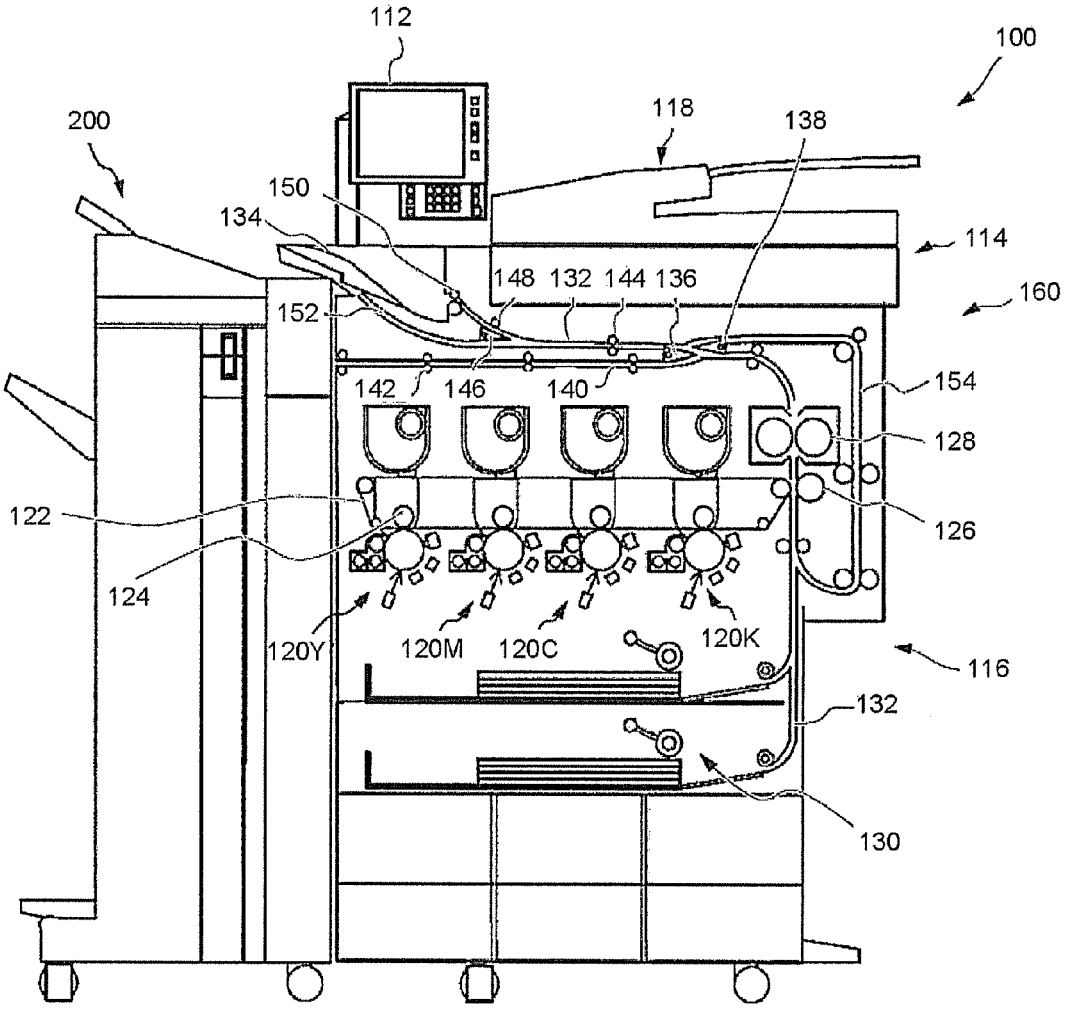
FIG. 2 is a diagram illustrating the schematic configuration of an image forming apparatus.

FIG. 2 is a diagram illustrating the schematic configuration of the image forming apparatus 100. The image forming apparatus 100 has the operation panel 112, the scanner section 114, the printer section 116, a sheet feed section 130, an upper stage sheet discharge tray 134 and a first conveyance path.

The operation panel 112 has a touch panel type display section and various operation keys. The operation keys include, for example, a numeric keypad, a reset key, a stop key and a start key.

The display section displays an instruction item relating to a printing condition. A print item displayed on the display section is, for example, an item relating to a printing condition such as a sheet size, the number of copies, print density setting or finishing (stapling). The instruction of the displayed item is input from the display section. The operation panel 112 is an interface for receiving an instruction from a user.

The scanner section 114 has a reading unit. The reading unit has a document placing table, a carriage, an exposure lamp, a reflecting mirror, an imaging lens and a CCD (Charge Coupled Device).

The CCD is a photoelectric conversion element for acquiring reflected light to convert the reflected light to an electrical signal. There is an automatic document feeder 118 for conveying a document to a reading position above the document placing table. The reading unit of the scanner section 114 reads a document set in the document placing table or the automatic document feeder 118.

The printer section 116 forms an image corresponding to image data on the sheet. As the image data, the image data of the document read by the scanner section 114 and the image data received from the user terminal are listed.

The printer section 116 has a process unit 120, an intermediate transfer belt 122, a primary transfer device 124, a secondary transfer device 126 and a fixing section 128.

The process unit 120 has four process units 120Y, 120M, 120C and 120K. The process unit 120 is arranged in parallel on the intermediate transfer belt 122.

The process unit 120Y corresponds to yellow (Y) toner (recording material). The process unit 120M corresponds to magenta (M) toner. The process unit 120C corresponds to cyan (C) toner. The process unit 120K corresponds to black (K) toner.

The process unit 120 has a photoconductor, a laser unit, a charging device, a developing device, a cleaner and a discharge lamp. The laser unit forms an electrostatic latent image on the photoconductor. The charging device is arranged around the photoconductor. If an image forming processing is started by the printer section 116, the process unit 120 forms a toner image on the photoconductor.

The primary transfer device 124 faces the photoconductor of the process unit 120 across the intermediate transfer belt 122 as a transfer body. The primary transfer device 124 electrostatically transfers the toner image on the photoconductor onto the intermediate transfer belt 122.

The secondary transfer device 126 electrostatically transfers the toner image which is transferred onto the intermediate transfer belt 122 onto the sheet conveyed from the sheet feed section 130. The fixing section 128 fixes the toner image on the sheet.

The first conveyance path 132 conveys the sheet fed from the sheet feed section 130 to the fixing section 128 or the upper stage sheet discharge tray 134. There is a first branch member 136 and a second branch member 138 at the downstream side of the fixing section 128. The first branch member 136 and the second branch member 138 switch a conveyance direction of the conveyed sheet. The first branch member 136 conveys the sheet conveyed in the first conveyance path 132 to the direction of a second conveyance path 140 or the upper stage sheet discharge tray 134. The second branch member 138 is arranged at the upstream side of the sheet conveyance direction with respect to the first branch member 136 in the first conveyance path 132.

The second conveyance path 140 branches off from the first conveyance path 132 at a branch point at which the first branch member 136 is arranged. The second conveyance path 140 has a conveyance roller 142. The second conveyance path 140 conveys the sheet to the post-processing apparatus 200.

A reversal roller 144, a third branch member 146, and a reversal paper path 152 are arranged at the downstream side of the sheet conveyance direction with respect to the first branch member 136. A conveyance roller 148 and a sheet discharge roller 150 are further arranged at the downstream side of the sheet conveyance direction with respect to the first branch member 136.

If the sheet is guided to the reversal roller 144 by the first branch member 136, the sheet is conveyed to the sheet discharge roller 150. At this time, the sheet is conveyed to the sheet discharge roller 150 through the reversal roller 144, the third branch member 146 and the conveyance roller 148. The sheet discharge roller 150 discharges the sheet to the upper stage sheet discharge tray 134.

Figure 3:
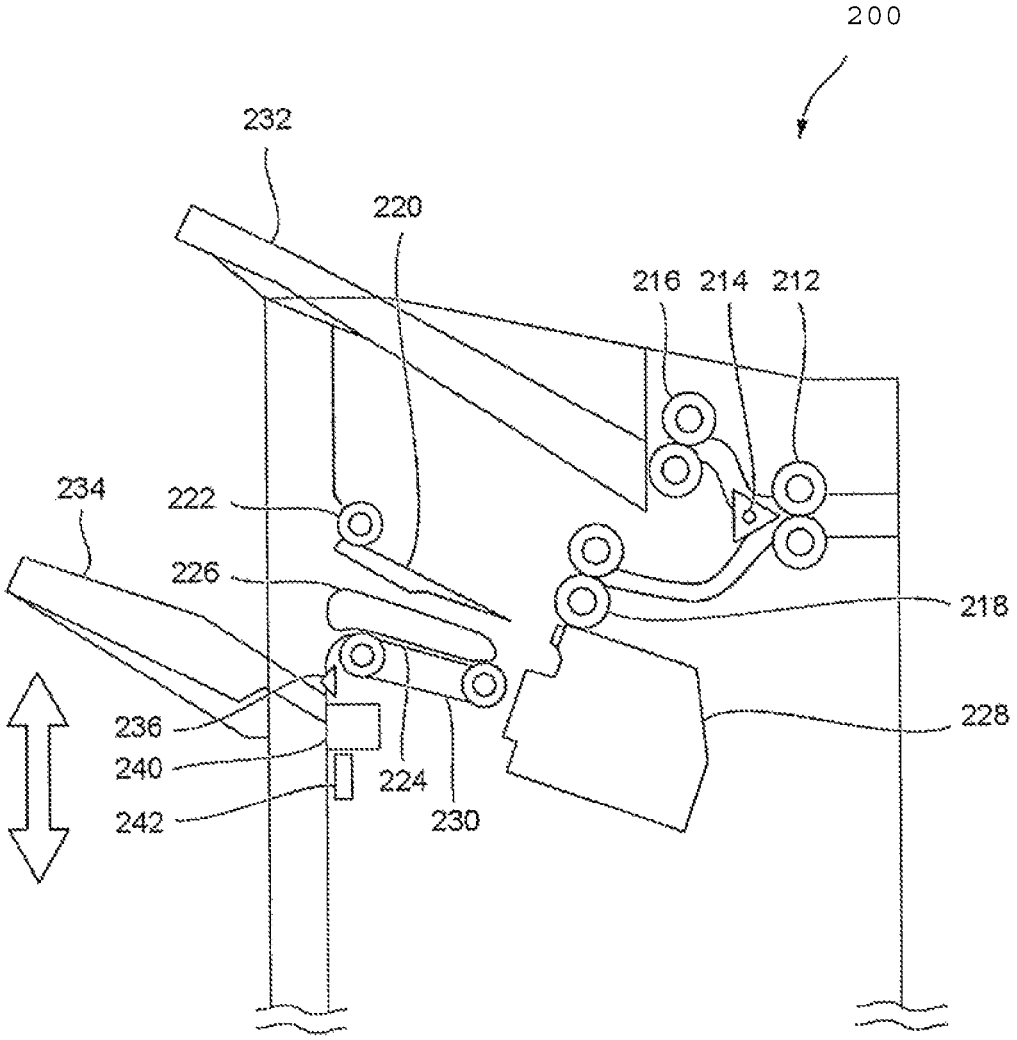
FIG. 3 is a diagram illustrating the schematic configuration of a post-processing apparatus.

FIG. 3 is a diagram illustrating the schematic configuration of the post-processing apparatus 200. The post-processing apparatus 200 processes the sheet discharged from the image forming apparatus 100 according to an input instruction from the operation panel 112 or an instruction from user equipment. The post-processing apparatus 200 has an inlet roller 212, a branch member 214, a sheet discharge roller 216, an exit roller 218, a standby tray 220, a standby roller 222, a processing tray 224, an alignment member 226, a stapler 228, a sheet bundle discharge member 230, a fixed tray 232, a movable tray 234, a DC motor 240 and an encoder 242.

The inlet roller 212 receives the sheet discharged from the image forming apparatus 100 and conveys the received sheet to the branch member 214. The branch member 214 guides the sheet to the sheet discharge roller 216 or the exit roller 218.

If the branch member 214 guides the sheet to the sheet discharge roller 216, the sheet discharge roller 216 discharges the sheet to the fixed tray 232. On the other hand, if the branch member 214 guides the sheet to the exit roller 218, the exit roller 218 conveys the sheet to the standby tray 220.

The standby tray 220 temporarily holds a plurality of the conveyed sheets. If supporting the predetermined number of the sheets, the standby tray 220 drops the supported sheets to the processing tray 224.

The processing tray 224 catches the sheets dropped from the standby tray 220. The processing tray 224 supports the loaded sheets while the sheets are stapled. The alignment member 226 aligns a width direction intersecting with a conveyance direction of a sheet bundle on the processing tray 224. The stapler 228 staples the end part of the aligned sheet bundle.

The sheet bundle discharge member 230 discharges the stapled sheet bundle to the movable tray 234. Furthermore, the sheet bundle discharge member 230 may discharge the sheet bundle to the movable tray 234 after the alignment member 226 aligns the sheet bundle without stapling the sheet bundle.

The standby tray 220 can also directly convey the supported sheet towards the direction of the movable tray 234 and discharge the conveyed sheet without dropping the supported sheet to the processing tray 224. In this case, the standby tray 220 and the standby roller 222 discharge the sheets one by one to the movable tray 234 without stopping the sheets on the standby tray 220.

The movable tray 234 is a driven member which is driven by the DC motor 240 in the vertical direction. The encoder 242 converts a revolution speed of an axis to which rotational force of the DC motor 240 is transmitted to a pulse and outputs the pulse to the control section 202. Specifically, the encoder 242 converts the revolution speed of the rotation axis obtained when a rotational speed of the DC motor 240 is decelerated to the pulse.

A detection member 236 detects the upper surface of the movable tray 234 or the top surface of the sheets loaded on the movable tray 234. The detection member 236 detects a position of the movable tray 234.

The movable tray 234 ascends or descends according to the discharge of the sheet from the standby tray 220, the discharge of the sheet from the processing tray 224 and a loading amount of the sheets. The movable tray 234 catches the discharged sheet at a position at which the detection member 236 detects the upper surface or the top surface. The movable tray 234 moves downwards, for example, when one or a plurality of sheets are discharged.

If the detection member 236 does not detect the top surface of the sheets loaded on the movable tray 234, the movable tray 234 moves upwards. The movable tray 234 moves to a position at which the detection member 236 detects the top surface of the sheets loaded on the movable tray 234 to load the discharged sheet.

In such a movable tray 234, if the lifetime of the DC motor 240 approaches and the rotational speed is reduced, paper jam occurs or an alignment state of the discharged sheets becomes faulty. In other words, the discharged sheets are in a disturbed state.

Specifically, in a state in which the sheets are loaded, if the descent of the movable tray 234 becomes slow, a sheet discharge port of the processing tray 224 becomes a blocked state. In this state, if the sheets are discharged by the processing tray 224, the paper jam occurs.

On the contrary, if the ascent of the movable tray 234 becomes slow, a distance between the sheet discharge port of the processing tray 224 and the movable tray 234 becomes an unnecessarily long state. In this state, if the sheets are discharged by the processing tray 224, the discharged sheets drop dancing in the air, and thus the alignment state of the discharged sheets becomes faulty.

Thus, the post-processing apparatus 200 makes a request to the image forming apparatus for a reduction in a processing speed if it is determined that the performance of the DC motor 240 becomes worse or the lifetime of the DC motor 240 approaches.

Figure 4:
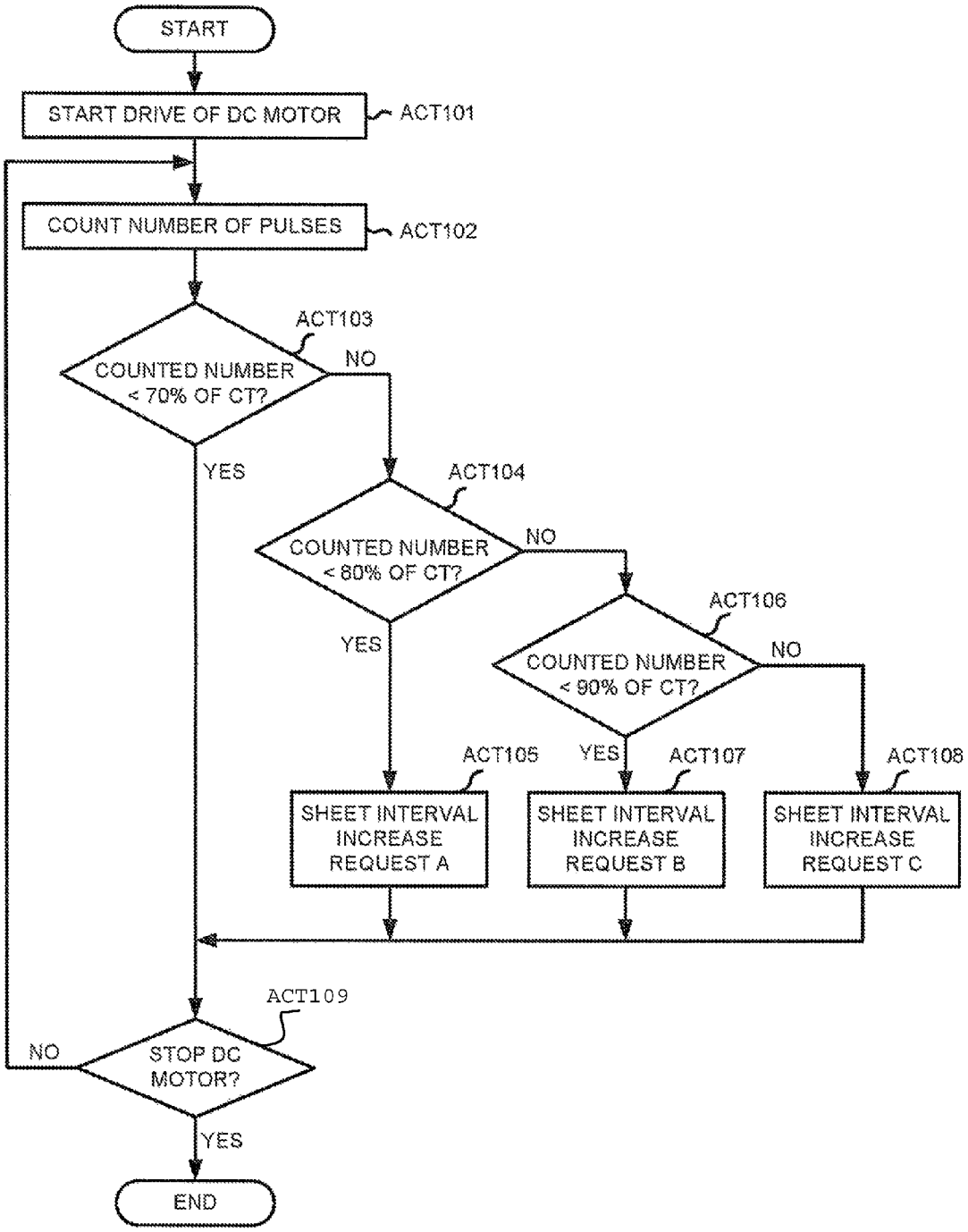
FIG. 4 is a diagram illustrating an example of operations of the post-processing apparatus.

FIG. 4 is a diagram illustrating an example of operations of the post-processing apparatus 200 according to the embodiment.

CT shown in FIG. 4 is a standard value for determining the lifetime of the DC motor 240. In a case in which counted number obtained by counting pulses output by the encoder 242 is set as the CT, it is determined that the lifetime of the DC motor 240 arrives. The counted number of the pulses is a physical quantity to be increased through the drive of the DC motor 240. Further, the counted number of the pulses which is used for determination is the total counted number (accumulated count number) from the time of shipment of the post-processing apparatus 200 and is stored in the memory 206. In FIG. 4, threshold values used for the determination are 70%, 80% and 90% of the CT.

If the counted number is smaller than 70% of the CT, the control section 202 determines that the lifetime of the DC motor is sufficient and does not make a request for the reduction in the processing speed. On the other hand, if the counted number is equal to or greater than 70% of the CT, the control section 202 makes a request for the reduction in the processing speed to the image forming apparatus 100.

A sheet interval increase request shown in FIG. 4 is a request for increasing a sheet discharge interval of each sheet, compared with normal time. Thus, the sheet interval increase request is a request for reducing the processing speed. The intervals requested by different sheet interval increase requests become longer in the order of a sheet interval increase request A, a sheet interval increase request B and a sheet interval increase request C.

The example of the operations shown in FIG. 4 is carried out in a state in which the sheets are not loaded on the movable tray 234. This is because a correct rotational speed cannot be detected if the sheets are loaded on the movable tray 234. Thus, the example of the operations shown in FIG. 4 is carried out, for example, according to an instruction of a service technician.

The control section 202 starts drive of the DC motor 240 in order to drive the movable tray 234 (ACT 101). The control section 202 counts the pulses output by the encoder 242. The control section 202 acquires updated total count number (accumulated count number) by adding the count number obtained by the encoder 242 to the total count number read from the memory 206 (ACT 102). The updated total count number is stored in the memory 206.

The control section 202 determines whether or not the total counted number is smaller than 70% of the CT (ACT 103). If it is determined that the total counted number is smaller than 70% of the CT (YES in ACT 103), the control section 202 proceeds to a processing in ACT 109.

The control section 202 determines whether or not the DC motor 240 stops (ACT 109). If it is determined that the DC motor 240 stops (YES in ACT 109), the control section 202 ends the present processing. If it is determined that the DC motor 240 does not stop (NO in ACT 109), the control section 202 proceeds to the processing in ACT 102.

In the foregoing processing in ACT 103, if it is determined that the total counted number is not smaller than 70% of the CT (NO in ACT 103), the control section 202 proceeds to a processing in ACT 104. The control section 202 determines whether or not the total counted number is smaller than 80% of the CT (ACT 104).

If it is determined that the total counted number is smaller than 80% of the CT (YES in ACT 104), the control section 202 makes a request to the image forming apparatus 100 for the sheet interval increase request A (ACT 105). Then, the control section 202 proceeds to the processing in ACT 109.

In the foregoing processing in ACT 104, if it is determined that the total counted number is not smaller than 80% of the CT (NO in ACT 104), the control section 202 proceeds to a processing in ACT 106. The control section 202 determines whether or not the total counted number is smaller than 90% of the CT (ACT 106).

If it is determined that the total counted number is smaller than 90% of the CT (YES in ACT 106), the control section 202 makes a request to the image forming apparatus 100 for the sheet interval increase request B (ACT 107). Then, the control section 202 proceeds to the processing in ACT 109.

In the foregoing processing in ACT 106, if it is determined that the total counted number is not smaller than 90% of the CT (NO in ACT 106), the control section 202 proceeds to a processing in ACT 108. The control section 202 makes a request to the image forming apparatus 100 for the sheet interval increase request C (ACT 108). Then, the control section 202 proceeds to the processing in ACT 109.

As shown in the example of the operations described above, the sheet discharge interval in the sheet interval increase request is increased according to an increase in the counted number.

The length of the interval requested by each sheet interval increase request may be optional as long as the post-processing apparatus can stably operate in the interval, compared with a case in which the sheet interval increase request is not carried out.

In FIG. 4 described above, the lifetime (performance degradation) of the DC motor is determined according to three threshold values, that is, 70%, 80% and 90%; however, the present invention is not limited to this. The lifetime of the DC motor may be determined according to one threshold value, two threshold values or four or more threshold values.

The DC motor is not limited to driving the movable tray and also drives other driven members. In a punch processing, the DC motor drives a member (punch blade) which punches a punch hole on the sheet. In a stapling processing, the DC motor drives a member which staples the sheets. In a folding processing, the DC motor drives a roller which discharges the sheet.

Figure 5:
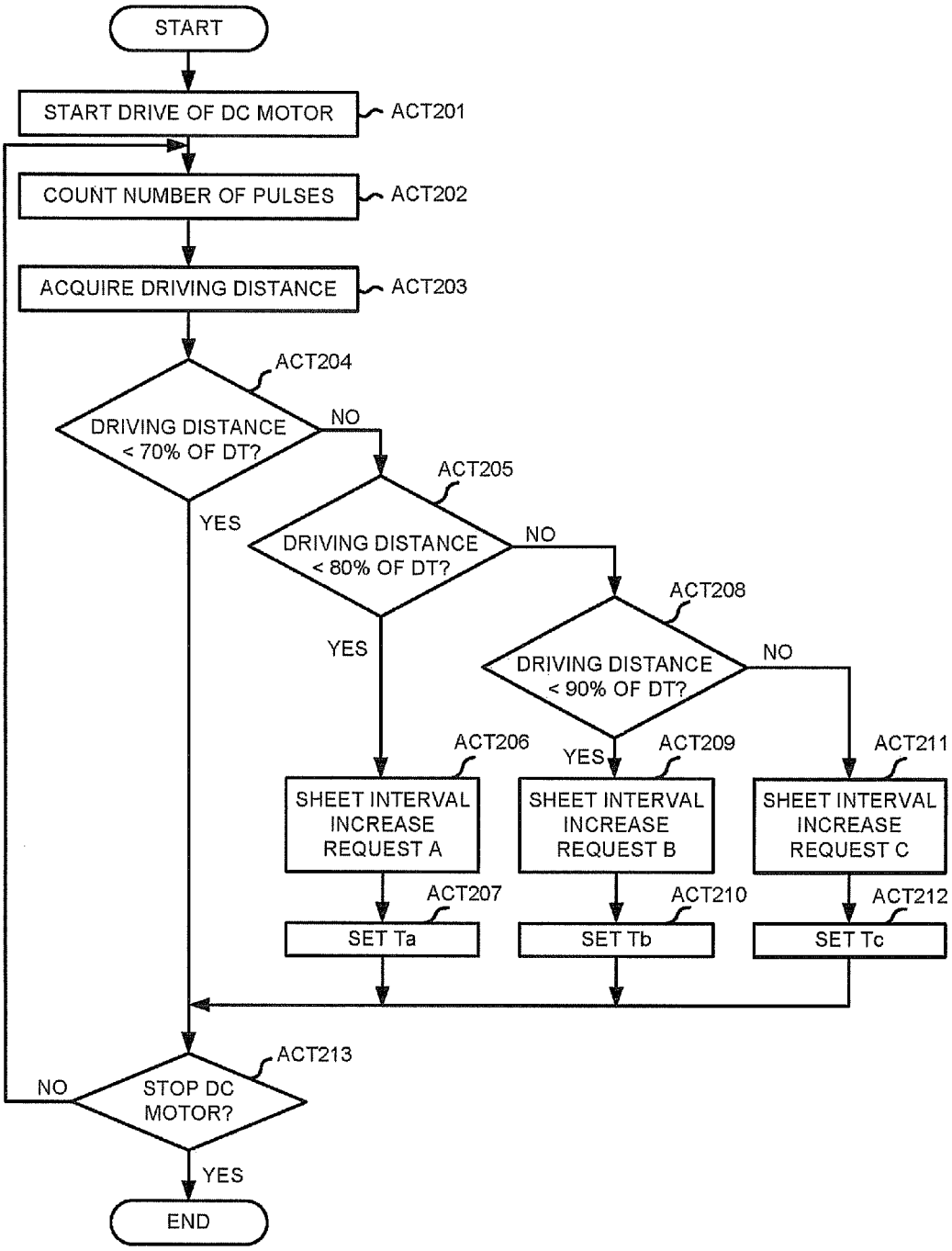
FIG. 5 is a diagram illustrating an example of operations of the post-processing apparatus.

FIG. 5 is a diagram illustrating an example of operations of the post-processing apparatus 200 in the punch processing according to the embodiment. A punch processing mechanism for carrying out the punch processing is not shown in FIG. 3; however, a punch is driven by the DC motor. Further, the punch processing mechanism has an encoder for converting a revolution speed of an axis to which the rotational force of the DC motor is transmitted to a pulse.

DT shown in FIG. 5 is a standard value for determining the lifetime of the DC motor. In a case in which the counted number obtained by counting the pulses output by the encoder is converted to a driving distance of a punch, and the driving distance of the punch is set to the DT, it is determined that the lifetime of the DC motor 240 arrives. The driving distance is a physical quantity to be increased through the drive of the DC motor 240. Further, the driving distance of the punch which is used for a determination is a total distance (accumulated distance) from the time of the shipment of the post-processing apparatus 200, and is stored in the memory 206. In FIG. 5, a threshold values used for the determination are 70%, 80% and 90% of the DT.

A sheet interval increase request shown in FIG. 5 is identical to the sheet interval increase request shown in FIG. 4. Furthermore, in FIG. 5, the reason why the sheet interval is increased is that the punch hole is punched on each one sheet.

If the driving distance is smaller than 70% of the DT, the control section 202 determines that the lifetime of the DC motor is sufficient and does not make a request for the reduction in the processing speed. On the other hand, if the driving distance is equal to or greater than 70% of the DT, the control section 202 makes a request for the reduction in the processing speed to the image forming apparatus 100.

The control section 202 starts drive of the DC motor 240 in order to drive the punch (ACT 201). The control section 202 counts the pulses output by the encoder (ACT 202). The control section 202 converts the counted number to the driving distance. The control section 202 acquires updated total driving distance (accumulated driving distance) by adding the driving distance obtained through the encoder 242 to the total driving distance read from the memory 206 (ACT 203). The updated total driving distance is stored in the memory 206.

The control section 202 determines whether or not the total driving distance is smaller than 70% of the DT (ACT 204). If it is determined that the total driving distance is smaller than 70% of the DT (YES in ACT 204), the control section 202 proceeds to a processing in ACT 213.

The control section 202 determines whether or not the DC motor stops (ACT 213). If it is determined that the DC motor stops (YES in ACT 213), the control section 202 ends the present processing. If it is determined that the DC motor does not stop (NO in ACT 213), the control section 202 proceeds to the processing in ACT 202.

In the foregoing processing in ACT 204, if it is determined that the total driving distance is not smaller than 70% of the DT (NO in ACT 204), the control section 202 proceeds to a processing in ACT 205. The control section 202 determines whether or not the total driving distance is smaller than 80% of the DT (ACT 205).

If it is determined that the total driving distance is smaller than 80% of the DT (YES in ACT 205), the control section 202 makes a request to the image forming apparatus 100 for the sheet interval increase request A (ACT 206).

The control section 202 sets conveyance stop time Ta (ACT 207). The conveyance stop time refers to time at which the conveyance of the sheet is stopped at the time the punch hole is punched. If the rotational force of the DC motor is reduced, the time for punching the hole is increased. Thus, the control section 202 increases conveyance stop time to the conveyance stop time Ta longer than normal conveyance stop time. After that, the control section 202 proceeds to the processing in ACT 213.

In the foregoing processing in ACT 205, if it is determined that the total driving distance is not smaller than 80% of the DT (NO in ACT 205), the control section 202 proceeds to a processing in ACT 208. The control section 202 determines whether or not the total driving distance is smaller than 90% of the DT (ACT 208).

If it is determined that the total driving distance is smaller than 90% of the DT (YES in ACT 208), the control section 202 makes a request to the image forming apparatus 100 for the sheet interval increase request B (ACT 209).

The control section 202 sets conveyance stop time Tb (ACT 210). Then, the control section 202 proceeds to the processing in ACT 213. The foregoing conveyance stop time Tb is longer than the conveyance stop time Ta.

In the foregoing processing in ACT 208, if it is determined that the total driving distance is not smaller than 90% of the DT (NO in ACT 208), the control section 202 proceeds to a processing in ACT 211. The control section 202 makes a request to the image forming apparatus 100 for the sheet interval increase request C (ACT 211).

As shown in the example of the operations described above, the sheet discharge interval in the sheet interval increase request is increased according to an increase in the driving distance.

The length of the interval requested by each sheet interval increase request may be optional as long as the post-processing apparatus can stably operate in the interval, compared with a case in which the sheet interval increase request is not carried out.

The control section 202 sets conveyance stop time Tc (ACT 212). Then, the control section 202 proceeds to the processing in ACT 213. The foregoing conveyance stop time Tc is longer than the conveyance stop time Tb.

Thus, the conveyance stop time becomes longer in the order of the conveyance stop time Ta, the conveyance stop time Tb and the conveyance stop time Tc.

In FIG. 5 described above, the lifetime (performance degradation) of the DC motor is determined according to three threshold values, that is, 70%, 80% and 90%; however, the present invention is not limited to this. The lifetime of the DC motor may be determined according to one threshold value, two threshold values or four or more threshold values.

Figure 6:
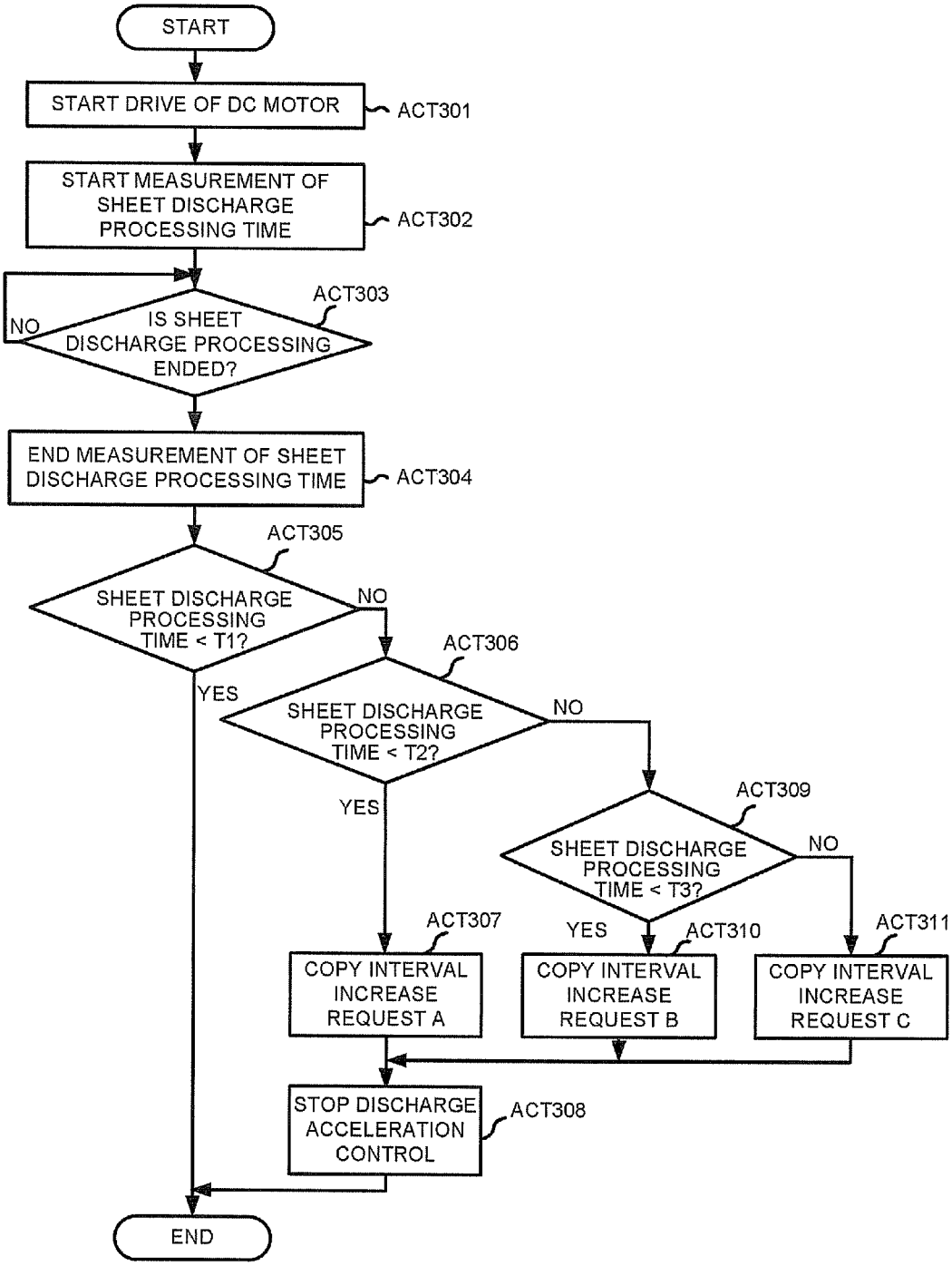
FIG. 6 is a diagram illustrating an example of operations of the post-processing apparatus.

FIG. 6 is a diagram illustrating an example of operations of the post-processing apparatus 200 in the folding processing according to the embodiment. A folding processing mechanism for carrying out the folding processing includes a pair of folding rollers and a folding blade, but is not shown in FIG. 3. In the folding processing, the front end of the folding blade pushes a sheet bundle at a position where a fold line is made to a nip portion of the pair of the folding rollers. The folding rollers driven by the DC motor folds the sheet. Then, the pushed sheet is accelerated by the folding rollers driven by the DC motor to be discharged. A processing from a moment the DC motor drives to a moment the sheet is discharged is referred to as a sheet discharge processing. Thus, the sheet discharge processing is a predetermined processing carried out through the drive of the DC motor. Time needed in the sheet discharge processing is a physical quantity to be increased through the drive of the DC motor. Further, the time of the sheet discharge processing which is used for a determination is a total time (accumulated time) of the sheet discharge processing since the post-processing apparatus 200 activates after its shipment. The total time is stored in the memory 206. The total time taken to the sheet discharge processing is used for the determination of the performance degradation.

T1, T2 and T3 (T1<T2<T3) shown in FIG. 6 are threshold values for determining the performance degradation of the DC motor. If the total time of the sheet discharge processing is smaller than the T1, the control section 202 determines that the lifetime (performance degradation) of the DC motor is sufficient and does not make a request for the reduction in the processing speed. On the other hand, if the total time is equal to or greater than the T1, the control section 202 makes a request for the reduction in the processing speed.

A copy interval increase shown in FIG. 6 is a request for increasing a sheet discharge interval between copies, compared with normal time. The copy interval refers to an interval from a moment the last page of one copy is discharged to a moment the first page of the next copy is discharged. For example, in a case in which one copy has 10 pages, the sheet discharge interval from the tenth page of the one copy to the first page of the next copy is the copy interval. Thus, the copy interval increase request is a request for reducing the processing speed. The intervals requested by different copy interval increase requests become longer in the order of a copy interval increase request A, a copy interval increase request B and a copy interval increase request C. In FIG. 6, the reason why the copy interval is increased is that each copy is discharged in the folding processing.

The control section 202 starts drive of the DC motor in order to drive the roller (ACT 301). The control section 202 starts measurement of the sheet discharge processing time (ACT 302). If the sheet discharge processing is ended (YES in ACT 303), the control section 202 ends the measurement of the sheet discharge processing time. The control section 202 acquires updated total time (accumulated time) by adding the sheet discharge processing time to the total time read from the memory 206. The updated total time is stored in the memory 206 (ACT 304).

The control section 202 determines whether or not the total time is smaller than the T1 (ACT 305). If it is determined that the total time is smaller than the T1 (YES in ACT 304), the control section 202 ends the present processing.

In the foregoing processing in ACT 305, if it is determined that the total time is not smaller than the T1 (NO in ACT 305), the control section 202 proceeds to a processing in ACT 306. The control section 202 determines whether or not the total time is smaller than the T2 (ACT 306).

If it is determined that the total time is smaller than the T2 (YES in ACT 306), the control section 202 makes a request to the image forming apparatus 100 for the copy interval increase request A (ACT 307). The copy interval increase request A is identical to that described in FIG. 5.

The control section 202 stops discharge acceleration control (ACT 308), and ends the present processing. The discharge acceleration control accelerates the speed at which the sheet is discharged. Through the copy interval increase request, time can be enough, and thus the control section 202 discharges the sheet at a constant speed without carrying out the discharge acceleration control.

In the foregoing processing in ACT 306, if it is determined that the total time is not smaller than the T2 (NO in ACT 306), the control section 202 proceeds to a processing in ACT 309. The control section 202 determines whether or not the total time is smaller than the T3 (ACT 309).

If it is determined that the total time is smaller than the T3 (YES in ACT 309), the control section 202 makes a request to the image forming apparatus 100 for the copy interval increase request B (ACT 310). Then, the control section 202 proceeds to the processing in ACT 308.

In the foregoing processing in ACT 309, if it is determined that the total time is not smaller than the T3 (NO in ACT 309), the control section 202 proceeds to a processing in ACT 311. The control section 202 makes a request to the image forming apparatus 100 for the copy interval increase request C (ACT 311). Then, the control section 202 proceeds to the processing in ACT 308. In this way, the sheet discharge interval in the request is increased according to an increase in the sheet discharge processing time.

In FIG. 6 described above, the lifetime of the DC motor is determined according to three threshold values, that is, T1, T2 and T3; however, the present invention is not limited to this. The lifetime of the DC motor may be determined according to one threshold value, two threshold values or four or more threshold values.

In the embodiment described above, in a case in which a plurality of the DC motors is arranged in the post-processing apparatus 200, a request for reducing a processing speed corresponding to a DC motor of which the lifetime is the nearest is carried out as a general rule. Exceptionally, a request for reducing a processing speed corresponding to a DC motor other than the DC motor of which the lifetime is the nearest may be carried out according to a processing content of the post-processing. Furthermore, the encoder 242 includes an incremental encoder, but is not limited to this. The encoder 242 may include an absolute encoder.

The number of the pulses described above is stored in the memory 206 of the post-processing apparatus 200; however, the present invention is not limited to this. The number of the pulses may be stored in, for example, the image forming apparatus 100 or a storage section such as a server connected with a network.

As the driven members driven by the DC motor, the movable tray, the punch and the roller for carrying out the folding processing are exemplified; however, the present invention is not limited to this. For example, the driven member may be a stapler or a roller for conveyance.

An execution timing of each of the examples of the operations described above may be, for example, a timing at which an initial operation at the time of power on is being carried out or a timing at which the paper jam is released.

According to the present embodiment described above, the post-processing apparatus can stably operate by making a request to the image forming apparatus for the reduction in the processing speed. Further, as the post-processing apparatus can stably operate, it is possible to extend an actual use period, compared with a case in which the present embodiment is not applied.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing apparatus, comprising:

a sheet processing section configured to carry out a sheet processing on a sheet discharged from an image forming apparatus;

a motor configured to drive a driven member of the sheet processing section;

a memory configured to store a threshold value and a first accumulated data of a physical quantity of one of the motor or the driven member driven by the motor; and a controller configured to acquire a predetermined data associated with a physical quantity of one of the driving motor or the driven member driven by the motor, acquire a second accumulated data by adding the predetermined data to the first accumulated data read from the memory, compare the second accumulated data with the threshold value, and transmit a request for increasing a discharge interval of sheets discharged from the image forming apparatus to the image forming apparatus if the second accumulated data is greater than the threshold value.

2. The sheet processing apparatus according to claim 1, wherein the controller is configured to store the second accumulated data in the memory.

3. The sheet processing apparatus according to claim 2, further comprising an encoder configured to output a pulse signal based on a rotation of an axis to which rotational force of the motor is transmitted, wherein the controller is configured to acquire a counted number obtained by counting the pulses converted by the encoder, acquire the second accumulated data by adding the counted number to the first accumulated data read from the memory, and transmit the request to the image forming apparatus if the second accumulated data is greater than the threshold value.

4. The sheet processing apparatus according to claim 3, wherein the driven member of the sheet processing section is a movable tray which moves in a vertical direction by the motor.

5. The sheet processing apparatus according to claim 2, further comprising an encoder configured to output a pulse signal based on a rotation of an axis to which rotational force of the motor is transmitted, wherein the controller is configured to acquire a moving distance of the driven member from a counted number obtained by counting the pulses converted by the encoder, acquire the second accumulated data by adding the moving distance to the first accumulated data read from the memory, and transmit the request to the image forming apparatus if the second accumulated data is greater than the threshold value.

6. The sheet processing apparatus according to claim 3, wherein the driven member is one of a movable tray which moves in a vertical direction by the motor and a blade of a punch which punches a hole on the sheet stopped at a punch processing position.

7. The sheet processing apparatus according to claim 5, wherein the driven member is a blade of a punch which punches a hole on the sheet stopped at a punch processing position, and the controller is configured to transmit the request to the image forming apparatus and extend a time for stopping the sheet in which the hole is made by the punch.

8. The sheet processing apparatus according to claim 2, further comprising a timer, wherein the first accumulated data in the memory indicates a value which accumulates an amount of time which the driven member is driven by the motor, the controller is configured to acquire a time data via the timer, after the motor starts driving and before the motor stops if the motor starts driving, acquire the second accumulated data by adding the time data to the first accumulated data read from the memory, compare the second accumulated data with the threshold value, and transmit the request to the image forming apparatus if the second accumulated data is greater than the threshold value.

9. A control method of a sheet processing apparatus which comprises a sheet processing section configured to carry out a sheet processing on a sheet discharged by an image forming apparatus, a motor configured to drive a driven member of the sheet processing section and a memory configured to store a threshold value and a first accumulated data of a physical quantity of one of the motor or the driven member driven by the motor, comprising acquiring a predetermined data associated with a physical quantity of one of the driving motor or the driven member driven by the motor;

acquiring a second accumulated data by adding the predetermined data to the first accumulated data read from the memory;

comparing the second accumulated data with the threshold value; and transmitting a request for increasing a discharge interval of sheets discharged from the image forming apparatus to the image forming apparatus if the second accumulated data is greater than the threshold value.

10. The method according to claim 9, further comprising storing the second accumulated data in the memory.

11. The method according to claim 10, further comprising receiving a pulse signal output by an encoder according to a rotation of an axis to which rotational force of the motor is transmitted;

acquiring a counted number obtained by counting the pulses;

acquiring the second accumulated data by adding the counted number to the first accumulated data read from the memory; and transmitting the request to the image forming apparatus if the second accumulated data is greater than the threshold value.

12. The method according to claim 11, wherein the driven member of the sheet processing section is a movable tray which moves in a vertical direction by the motor.

13. The method according to claim 10, further comprising receiving a pulse signal output by an encoder according to a rotation of an axis to which rotational force of the motor is transmitted;

acquiring a moving distance of the driven member from a counted number obtained by counting the pulses;

acquiring the second accumulated data by adding the moving distance to the first accumulated data read from the memory; and transmitting the request to the image forming apparatus if the second accumulated data is greater than the threshold value.

14. The method according to claim 13, wherein the driven member is one of a movable tray which moves in the vertical direction by the motor and a blade of a punch which punches a hole on the sheet stopped at a punch processing position.

15. The method according to claim 13, wherein the driven member is a blade of a punch which punches a hole on the sheet stopped at a punch processing position, and the method further comprising:

extending a time for stopping the sheet in which the hole is made by the punch by transmitting the request to the image forming apparatus.

16. The method according to claim 10, wherein the first accumulated data in the memory indicates a value which accumulates an amount of time which the driven member is driven by the motor, the method further comprising:

acquiring a time data via a timer, after the motor starts driving and before the motor stops if the motor starts driving;

acquiring the second accumulated data by adding the time data to the first accumulated data read from the memory;

comparing the second accumulated data with the threshold value; and transmitting the request to the image forming apparatus if the second accumulated data is greater than the threshold value.

17. An image forming system, comprising:

an image forming apparatus;

a sheet processing section configured to carry out a sheet processing on a sheet discharged from the image forming apparatus;

a motor configured to drive a driven member of the sheet processing section;

a storage device configured to store a threshold value and a first accumulated data of a physical quantity of one of the motor or the driven member driven by the motor; and a controller configured to acquire a predetermined data associated with a physical quantity of one of the driving motor or the driven member driven by the motor, acquire a second accumulated data by adding the predetermined data to the first accumulated data, compare the second accumulated data with the threshold value, and generate a signal for increasing a discharge interval of sheets discharged from the image forming apparatus to the image forming apparatus if the second accumulated data is greater than the threshold value.

18. The system according to claim 17, wherein the controller is configured to store the second accumulated data in the storage device.

19. The system according to claim 18, further comprising an encoder configured to output a pulse based on a rotation of an axis to which rotational force of the motor is transmitted, wherein the controller is configured to acquire a counted number obtained by counting the pulses converted by the encoder, acquire the second accumulated data by adding the counted number to the first accumulated data read from the storage device, and generate the signal if the second accumulated data is greater than the threshold value.

20. The system according to claim 19, wherein the sheet processing section includes a movable tray which moves in a vertical direction by the motor.

* * * * *